United States Patent [19]

Narita et al.

[11] 4,378,994

[45] Apr. 5, 1983

[54] METHOD FOR ESTIMATING GEOGRAPHICAL DISTRIBUTION OF COHESIVE ZONE IN BLAST FURNACE

[75] Inventors: Kiichi Narita, Kobe; Shinichi Inaba, Kakogawa; Masakata Shimizu, Kobe; Kenichi Okimoto, Hyogo; Isao Kobayashi, Miki, all of Japan

[73] Assignee: Kobe Steel, Ltd., Kobe, Japan

[21] Appl. No.: 223,586

[22] Filed: Jan. 9, 1981

[30] Foreign Application Priority Data

Jan. 9, 1980 [JP] Japan ..... 55-1631

[51] Int. Cl.[3] ..... C21B 7/24

[52] U.S. Cl. ..... 75/41; 266/79

[58] Field of Search ..... 75/41, 42; 266/78, 79, 266/80

[56] References Cited

U.S. PATENT DOCUMENTS

| | | | |
|---|---|---|---|
| 2,713,124 | 7/1955 | Graham | 250/43.5 |
| 3,581,070 | 11/1968 | Tsujihata et al. | 266/78 |
| 3,588,067 | 8/1969 | Shimotsuma et al. | 75/41 |
| 4,122,392 | 10/1978 | Takeuchi et al. | 75/41 |
| 4,197,495 | 4/1980 | Matsui et al. | 324/207 |

FOREIGN PATENT DOCUMENTS

| | | | |
|---|---|---|---|
| 1508465 | 4/1966 | Fed. Rep. of Germany | 266/78 |
| 1293177 | 4/1969 | Fed. Rep. of Germany | 266/78 |
| 2312669 | 3/1973 | Fed. Rep. of Germany | 266/78 |
| 49-1041602 | 7/1974 | Japan | 266/280 |

*Primary Examiner*—M. J. Andrews

*Attorney, Agent, or Firm*—Oblon, Fisher, Spivak, McClelland & Maier

[57] ABSTRACT

A method for estimating the geographical distribution of a cohesive zone in a blast furnace which is intermittently charged with an iron ore material to produce molten iron substantially in a continuous manner is disclosed. The method comprises altering the whole or part of the composition of the charging iron ore material at a certain time point, measuring variations in the composition of produced molten iron ore slag over a given time period, and estimating the shape of the cohesive zone in the furnace on the basis of a pattern of variation of one selected component and the speed of gravitational descent of the charged material through the furnace.

5 Claims, 3 Drawing Figures

METHOD FOR ESTIMATING GEOGRAPHICAL DISTRIBUTION OF COHESIVE ZONE IN BLAST FURNACE

BACKGROUND OF THE INVENTION

1. Field of the Invention

This invention relates to a method for estimating the shape of a fusion belt in a blast furnace for stabilization of its operation control.

2. Description of the Prior Art

In a blast furnace, iron ore and coke which are charged in alternate layers are reduced by rising reducing gas while they slowly go down the furnace. The ore which has undergone changes in composition by the reduction shows inherent softening and melting points but since the furnace temperature becomes higher in the lower portions of the furnace the ore sooner or later reaches a region of the same temperature level as its softening and melting points. There, the massive layer is not fused immediately but generally softens and melts upon reaching a certain temperature region and then starts to drip, forming molten pig iron and slag. That is, a softened and fused layer of ore exists in a certain locality of the furnace which is generally called "saftening-menting zone" (hereinafter referred to simply as "cohesive zone"). The shape of such a fusion belt in the blast furnace has thus far been in the realm of mere guesswork until recent studies on disassembled blast furnaces, conducted by furnace manufacturers, revealed that the cohesive zone has a large distribution in the vertical direction of the furnace as well as in a transverse sectional area. It has also been revealed that these distributions are closely related to the furnace conditions, showing various patterns depending upon the furnace conditions. A typical pattern is diagrammatically shown in FIG. 1, depicting a blast furnace 1 charged with alternate layers of iron ore 3 (e.g., in the form of pellets or sintered ore) and coke 4, via the top 1*a* of the furnace 1. The reference numeral 6 indicates a massive zone of the descending layers upstream of a cohesive zone 7 which is formed in an inverted V-shape in the shaft portion 1*b* of the furnace 1, molten pig iron and slag dripping through and along a coke layer 5 enveloped by the cohesive zone 7 in a center portion of the furnace. On the other hand, hot blasts admitted through tuyeres or inlets 2 ascend the shaft 1*b* as indicated by arrows, said hot blasts however being blocked by the cohesive zone 7 which is extremely low in void fraction and gas permeability due to its inherent physical properties. Therefore, the reducing gas which has ascended through the center coke layer 5 is, upon reaching the underside of the melt bonded layer 7, distributed in upward and radial directions as indicated by arrows in FIG. 1. The upwardly distributed gas ascends through the center coke layer 5 along the cohesive zone 7, while the radially distributed gas flows toward the massive zone 6 through openings or slits 7' in the cohesive zone 7. Namely, the cohesive zone 7 has the function of distributing the climbing gas so that the degree of distribution of the gases within the furnace is greatly influenced by the shape, and particularly the distribution, of the cohesive zone 7 itself. For example, in a case where the cohesive zone 7 is maldistributed in the center portion of the furnace, the climbing gas flows take place mainly in the peripheral portions of the furnace. On the other hand, in a case where the cohesive zone 7 is maldistributed in the peripheral portions of the furnace, the gas flows take place mainly in the center portion of the furnace. The reduction of the cohesive zone 7 is accelerated in its peripheral portions by the peripheral gas flows and in the center portion by the center gas flows, not only giving direct influence to the shape of the next melt massive belt but also prevailing as a predominant factor of the reducing process.

In view of these circumstances, it has been found that the shape of the melt mass belt has an important influence on the smooth gravitationally induced descent of the ore burden and the effective distribution of the reduding gas. Therefore it is necessary to maintain the cohesive zone in an appropriate form in order to ensure smooth operation and high productivity of the blast furnace. To this end, the shape of the cohesive zone at any given time has to be grasped and understood precisely, and as soon as possible. However, at the present stage of the art, the shape is usually speculated by estimate calculations based on data of measurements from the outside and in the absence of an established method for dynamically grasping the shape of the cohesive zone in actual furnaces.

SUMMARY OF THE INVENTION

With the foregoing in view, the present invention has as its object the provision of a method for promptly and precisely recognizing the current condition of a cohesive zone in actual furnaces.

According to the present invention, there is provided a method for estimating the shape of a cohesive zone in a blast furnace which is intermittently charged with iron ore to produce pig iron substantially in a continuous manner. The method comprises altering the whole or part of the composition the charging iron ore material at a certain time point; measuring variations in the composition of produced molten iron or slag over a given time period; and estimating the shape of the cohesive zone in the furnace on the basis of a pattern of variation of one selected component and the speed of the gravitational descent of the charged material through the furnace.

With the method of the present invention, it becomes possible to estimate the geographical distribution of a cohesive zone in a precise and prompt manner in actual operations and to maintain the cohesive zone in an ideal form by controlling various operating conditions (e.g., the blast temperature, blast rate, gas speed at the tuyeres, oxygen content in blasts, iron ore properties at high temperatures, charging method, etc.) in relation to the estimated shape of the fusion belt.

The above and other objects, features and advantages of the invention will become apparent from the following description and the appended claims, taken in conjunction with the accompanying drawings.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE INVENTION

According to the method of the present invention, part or all of the composition of the iron ore to be charged at a certain time point is varied. This can be attained, for instance, by (1) adding to the iron ore charge a radioactive isotope (R.I.) to serve as a tracer, while detecting the R.I. content in the molten pig iron and slag withdrawn from the furnace;

(2) adding to the iron ore charge an element which is susceptible of radio-activation (e.g., gold, copper tungsten or the like), and detecting the same in a similar manner; or (3) increasing or reducing one selected component of the iron ore charge (or changing the ore itself), while detecting variations in the content of the selected component in the molten pig iron and slag.

Although some exemplary methods are given above, it is to be noted that the present invention is not limited to those methods. The R.I. method is adopted in the following description as a representative example but other methods may be employed if desired, with necessary alterations in minor details.

Figure 2:
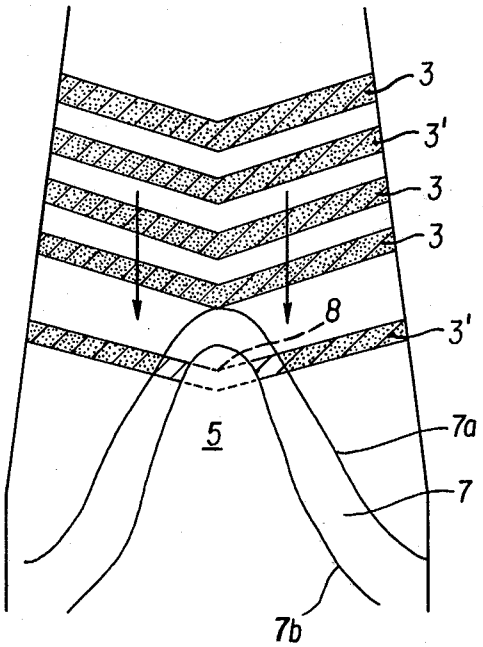
FIG. 2 is a diagrammatic view showing the principles of the method of the present invention.
Figure 1:
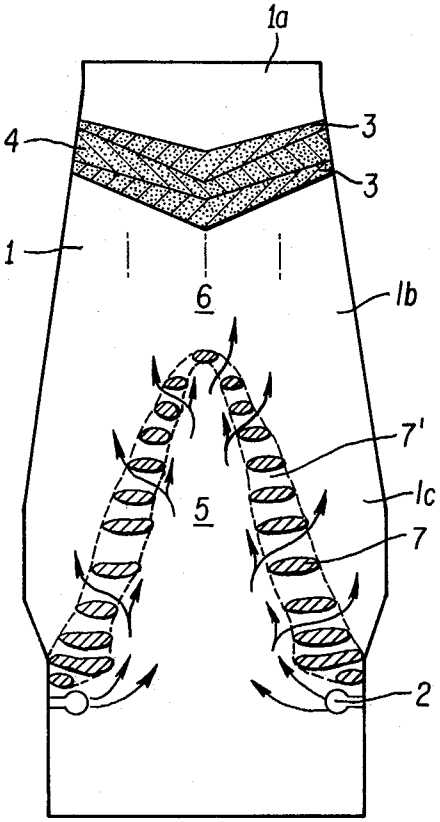
FIG. 1 is a diagrammatic view of a cohesive zone in a blast furnace.

As conceptually illustrated in FIG. 2, in sequentially charging ore layers 3 in a blast furnace, ore which is blended with a R.I. is charged at an arbitrary time point, forming an ore layer 3' which may be called a tracer ore layer. The tracer ore layer 3' is preferrably formed by piling iron ore in as uniform a thickness as possible. Immediately thereafter, the distribution of the piled iron ore is measured by the use of a suitable measuring device, recording the variations in the piled amount of ore in the radial direction. The iron ore layers 3, 3' thus formed descend along the shaft as the operation of the furnace proceeds, and part of the tracer ore layer 3' (the center portion in the example shown) reaches a high temperature zone which is constituted by the cohesive zone 7. The cohesive zone 7 is bounded by an initial softening surface 7*a* on the upper, lower-temperature, side and by an initial dripping surface 7*b* on the lower, higher-temperature, side. Therefore, at the time point when the descending tracer ore layer 3' reaches the position shown in FIG. 2, the portion which is indicated at 8 has already been melted and dripped onto the bottom of the furnace. Upon further descent, the tracer ore layer 3' is softened and melted from its center portion towards the edges and drips to join the molten iron and slag which are stored at the bottom of the furnace and being withdrawn from the furnace. Thus, the dripped R.I. is mixed in with the molten iron and slag which are discharged from the furnace, so that the descending condition of the tracer ore layer 3' as well as its profile during descent can be estimated by measuring the amount of the discharged R.I. over a certain time period.

Figure 3I:
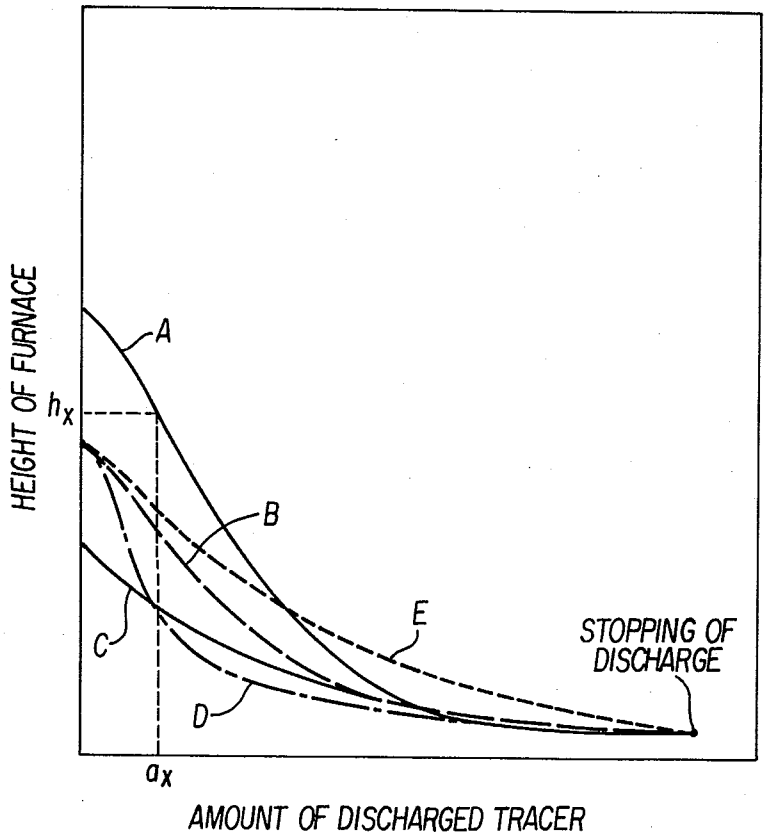
FIGS. 3(I) and 3(II) are graphs showing the procedures of estimation by the method of the invention.
Figure 3:
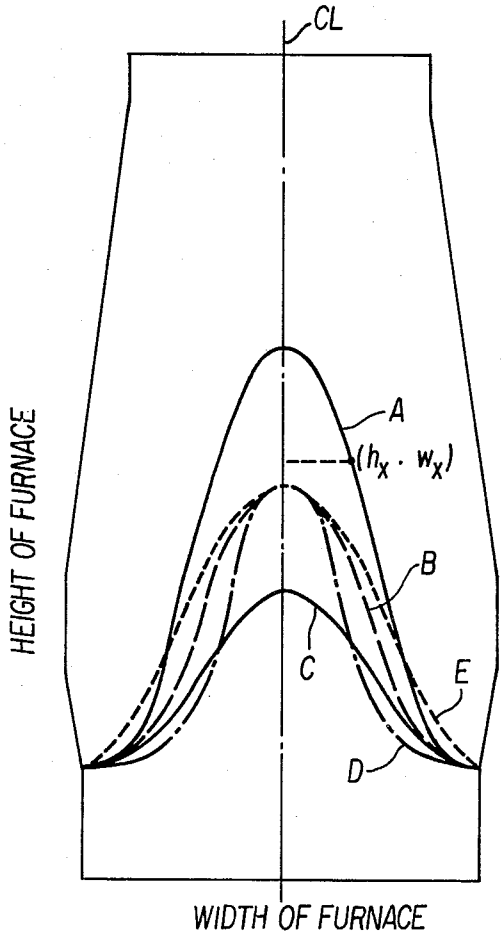

FIG. 3 is an example of data processing for estimating such profile taking into account the effect of molten iron and slag stored at the bottom of the furnace, showing the relation between the timewise variations in the discharged amount of R.I. and the gravitational speed of the tracer ore layer in Experimental Examples A to F. FIG. 3(I) shows the relation between the height of the furnace vs. the amount of the discharged tracer, while FIG. 3(II) shows the geometrical profiles of the fusing faces of the fusion belts obtained from discharge curves A to E, respectively.

More particularly, in Example A where the accumulated discharge amount of R.I. is increased gradually for some time after the initial R.I. discharge point and it is abruptly increased immediately before the terminal point of the R.I. discharge, the profile of the cohesive zone is estimated from the following:

(1) Estimation of the height of the initial melting surface may be had from the time duration between the R.I. charging point and the initial R.I. discharge point. Thus the height of the furnace for the curves in FIG. 3 (I) is estimated from such time, with the height decreasing as the time increases.

(2) Estimation of the height of the final melting surface may be had from the time duration between the initial and terminal points of R.I. discharge.

(3) Estimation of the conical degree or slope of the profile of the melting surface may be had on the basis of the variations in the rate of accumulated discharge amount of R.I.

(4) Estimation of the distance $w_x$ from the center of the furnace to the melting surface may be had on the basis of the height $h_x$ of the RI-added ore layer at time $t_x$ after the initial RI discharge and the accumulated discharge amount $a_x$ at the time which is proportional to the area defined by a plane intersecting the melting surface as sectioned at the height $h_x$.

(5) The profile of the melting surface in Example A is estimated as at A of FIG. 3(II) by calculations of the height $h_x$ and the distance $w_x$ over a given time period. For example, in FIG. 3(I), the discharge amount $a_x$ is found at a time corresponding to an estimated height of $h_x$. Since, for a change in estimated height the amount $a_x$ changes slowly, a narrow profile is estimated for A.

In Example B which is substantially the same as Example A in the R.I. discharge pattern except for the delay of the initial R.I. discharge point, the profile of the fusing surface is estimated as being B of FIG. 3(II). Further, the increase in the R.I. discharge amount in Example B is faster than in Example A as shown in FIG. 3(I), so that the estimated profile is gently sloped as compared with that of Example A. In Example C, the initial R.I. discharge point is further delayed and the accumulated discharge amount is increased more rapidly with achange in height as shown in FIG. 3(I), so that the profile is estimated to have an extremely low conical shape as shown in FIG. 3(II). Examples D and E have the initial discharge point substantially at the same height as in Example B but the tendency of increase of the accumulated R.I. discharge amount in the initial period in Example I is more acute than in Example D. Thus, the fusing surface in Example E has a broad profile as shown in FIG. 3(II), in contrast to the narrow profile of Example D.

As is clear from the foregoing description, the method of the present invention is capable of precisely estimating the shape or distribution of a cohesive zone in a blast furnace by detecting variations in the content of a component in discharged molten iron or slag which reflects the geographical distribution of the charged material in the furnace. Therefore, it becomes possible to control and maintain the furnace operation in a better condition.

Obviously, numerous additional modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A method for estimating the geographical distribution of a fusion belt in a blast furnace which is intermittently charged with an iron ore material to produce molten iron in a continuous manner, said method comprising:

altering at least a part of the composition of the charging iron ore material at a certain time point;

measuring variations in the composition of the produced molten iron ore and slag over a given time period; and estimating from said measured variations, the shape of said fusion belt in said furnace wherein the shape of said fusion belt is estimated from a relation of a pattern of variation of at least one selected component of said furnace at a point downstream from said fusion belt and the speed of gravitational descent of said charged material in said furnace.

2. The method of claim 1 wherein one of said at least one selected components includes said altered part.

3. A method as set forth in claim 1, wherein the step of altering at least a part of the composition of said charging ore material is the addition of a radioactive tracer material.

4. A method as set forth in claim 1, wherein the step of altering at least a part of the composition of said charging iron ore material is the addition of an element susceptible to radioactivation.

5. A method as set forth in claim 1, wherein an iron ore material of a different composition is charged as said step of altering at least a part of the composition of said material.

* * * * *

UNITED STATES PATENT AND TRADEMARK OFFICE

CERTIFICATE OF CORRECTION

PATENT NO. : 4,378,994

DATED : April 5, 1983

INVENTOR(S) : KIICHI NARITA ET AL

It is certified that error appears in the above-identified patent and that said Letters Patent is hereby corrected as shown below:

In column 2, line 12, delete "reduding" and insert therefor --reducing--;

In column 3, line 32, delete "preferrably" and insert therefor --preferably--;

In column 4, line 46, insert space between "a" and "change".

Signed and Sealed this

*Twenty-seventh* Day of *September 1983*

[SEAL]

*Attest:*

GERALD J. MOSSINGHOFF

*Attesting Officer*

*Commissioner of Patents and Trademarks*